US006167336A

United States Patent [19]

Singh et al.

[11] Patent Number: 6,167,336

[45] **Date of Patent: *Dec. 26, 2000**

[54] METHOD AND APPARATUS FOR DETERMINING AN EXCAVATION STRATEGY FOR A FRONT-END LOADER

[75] Inventors: Sanjiv Singh, Pittsburgh; Howard Cannon, Gibsonia, both of Pa.

[73] Assignee: Carnegie Mellon University, Pittsburgh, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 09/080,604

[22] Filed: May 18, 1998

[51] Int. Cl.[7] ..... G06F 19/00; E02F 3/34

[52] U.S. Cl. ..... 701/50; 172/2; 37/348; 37/414

[58] Field of Search ..... 701/23, 50, 300; 37/347, 348, 414, 415; 172/2.3, 4.5, 9; 414/699

[56] References Cited

U.S. PATENT DOCUMENTS

| | | | |
|---|---|---|---|
| 5,528,843 | 6/1996 | Rocke | 37/348 |
| 5,816,335 | 10/1998 | Yamamoto et al. | 172/4.5 |
| 5,854,988 | 12/1998 | Davidson et al. | 701/50 |
| 5,875,854 | 3/1999 | Yamamoto et al. | 172/4.5 |
| 5,924,493 | 7/1999 | Hartman et al. | 701/50 |
| 5,941,921 | 8/1999 | Dasys et al. | 701/50 |
| 5,968,103 | 10/1999 | Rocke | 701/50 |
| 5,974,352 | 10/1999 | Shull | 701/50 |
| 6,076,030 | 6/2000 | Rowe | 701/50 |

FOREIGN PATENT DOCUMENTS 10-88625 4/1998 Japan .

OTHER PUBLICATIONS

Sanjiv Singh & Reid Simmons, Task Planning for Robotic Excavation, Jul. 1992.

Takahashi et al, Autonomous Shoveling of Rocks by Using Image Vision System on LHD, Jun. 1995.

*Primary Examiner*—Gary Chin

*Attorney, Agent, or Firm*—Blackwell Sanders Peper Martin

[57] ABSTRACT

In one embodiment of the present invention, a planning apparatus and method for earthmoving operations with a front-end loader, such as loading a bucket with material and unloading the material in a receptacle, is disclosed including multi-level processing for planning the operation. One of the processing levels is a coarse-level planner that uses geometry of the site and heuristics specified by expert operators to find an optimal area from which to remove material. The next level involves searching the area for an exact starting location. This is accomplished by choosing among candidate excavations for the site with the optimum performance criteria including maximum amount of material protruding from the pile, minimum side loading of the bucket, and minimum distance from the loading receptacle. Other performance criteria that are evaluated for the candidate excavation include whether the front-end loader is capable of making the turns required by a candidate trajectory, and whether obstacles are in the path of the trajectory.

16 Claims, 6 Drawing Sheets

$$SL = 1 - \frac{|V1 - V2|}{V1 + V2}$$

$$C = \frac{\text{VOLUME INSIDE BUCKET}}{\text{BUCKET CAPACITY}}$$

$$L = MAX\left(0,1 - \frac{\text{DISTANCE TO TRAVEL}}{\text{MAX ACCEPTABLE DISTANCE}}\right)$$

METHOD AND APPARATUS FOR DETERMINING AN EXCAVATION STRATEGY FOR A FRONT-END LOADER

TECHNICAL FIELD

This invention relates generally to an apparatus and method for planning a strategy for performing an excavating operation by an earthmoving machine, and more particularly, to an apparatus and method for determining an optimum excavation strategy for a front-end loader by evaluating a series of candidate excavations.

BACKGROUND ART

Machines such as excavators, backhoes, front shovels, and the like are used for earthmoving work. These earthmoving machines have work implements which consist primarily of a work bucket linkage. The work bucket linkage is controllably actuated by at least one hydraulic cylinder. An operator typically manipulates the work implement to perform a sequence of distinct functions to load the bucket.

In a typical front-end loader work cycle, the operator first positions the bucket linkage at a pile of material and lowers the bucket downward until the bucket is near the ground surface. Then the operator subsequently raises the bucket through the pile to fill the bucket, and racks or tilts back the bucket to capture the material. The operator backs up the front-end loader from the pile and drives toward a loading receptacle. Finally, the operator dumps the captured load in the loading receptacle and maneuvers the front-end loader back to the pile to begin the work cycle again.

There is an increasing demand in the earthmoving industry to automate the work cycle of a machine such as a front-end loader for several reasons. Unlike a human operator, an automated front-end loader remains consistently productive regardless of environmental conditions and prolonged work hours. The automated front-end loader is ideal for applications where conditions are unsuitable or undesirable for humans. An automated front-end loader also enables more accurate loading and compensates for lack of operator skill.

The major components for autonomous loading, e.g., loading the work implement from a pile of material, recognizing loading receptacle positions and orientations, and loading the material from the work implement into the loading receptacle, are currently under development. All of these functions are typically performed by planning and control system software in computers which output signals to drive servo-actuators on the machine. The planning steps required to determine a strategy for an optimal loading is required. The specific location for removing material from a pile, and the approach of the implement to the excavation start point must be determined so that the loading process is performed as efficiently as possible.

There are systems in the prior art that attempt to automate only specific portions of earthmoving operations, and they typically do not adapt to operation over varying terrain as the excavation progresses. This is primarily because environmental perception in conditions that exist at work sites is a very difficult problem. The most sophisticated earthmoving systems have required the operator to place the bucket at the starting location and a control system takes over the process of filling the bucket, using force and/or joint position feedback to accomplish the task. See, for example, Sameshima, M. and Tozawa, S., "Development of Auto Digging Controller for Construction Machine by Fuzzy Logic Control," In *Proc. of Conference Japanese Society of Mechanical Engineers,* 1992. At the next level of autonomy are systems that automatically select where to dig. Such systems measure the topology of the terrain using ranging sensors. See, for example, Feng, P. and Yang, Y. and Qi, Z and Sun, S., "Research on Control Method of Planning Level for Excavation Robot," *Proc. 9th International Symposium on Automation and Robotics in Construction,* Tokyo, 1992. Singh, S., *Synthesis of Tactical Plans for Robotic Excavation,* Ph.D Thesis, January, 1995, Robotics Institute, Carnegie Mellon University, Pittsburgh, Pa. 15213. Takahashi, H., Damata, H., Masuyama, T., Sarata, S., "Autonomous shoveling of rocks by using image vision system on LHD," In Proc., *International Symposium on Mine Mechanization and Automation,* June 1995, Golden, Colo. Given the profile of the terrain, optimal digs, or those that maximize excavated volume while minimizing other criteria such as time and energy, are computed. At the highest level of autonomy are proposed systems that sequence the operation of an earthmover over a long period. However, the proposed systems do not disclose means to automate the entire excavation process.

Accordingly, the present invention is directed to overcoming one or more of the problems as set forth above.

DISCLOSURE OF THE INVENTION

In one embodiment of the present invention, an apparatus and method for earthmoving operations with a front-end loader, such as loading a bucket with material and unloading the material in a receptacle, is disclosed including multilevel processing for planning the operation. One of the processing levels is a coarse-level planner that uses geometry of the site and heuristics specified by expert operators to find an optimal area from which to remove material. The next level involves searching the area for an exact starting location. This is accomplished by choosing among candidate excavations for the site with the optimum performance criteria including maximum amount of material protruding from the pile, minimum side loading of the bucket, and minimum distance from the loading receptacle. Other criteria that are evaluated for the candidate excavation include whether the front-end loader is capable of making the turns required by a candidate trajectory, and whether obstacles are in the path of the trajectory.

BEST MODE FOR CARRYING OUT THE INVENTION

Figure 1:
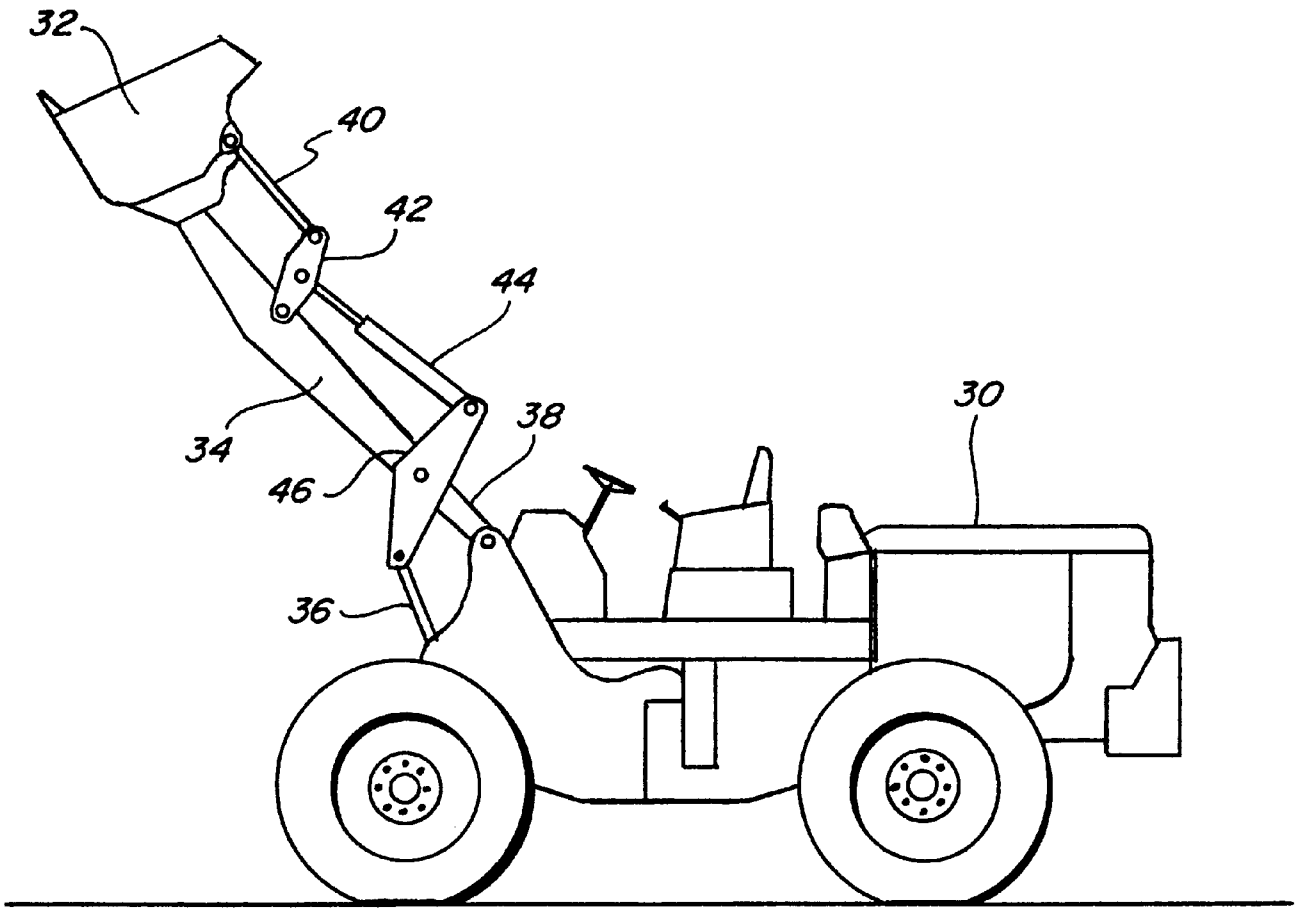
FIG. 1 is a side view of an example of a front-end loader that may be used with the present invention.

FIG. 1 shows a side view of a front-end loading machine 30 having a work implement that includes a bucket 32 as an example of the type of front-end loaders to which the present invention may apply. The bucket 32 is connected to a lift arm assembly 34. The lift arm assembly 34 is pivotally actuated by two hydraulic lift cylinders 36 (only one of which is shown) about a pair of lift arm pivot pins 38 (only one shown) attached to the machine frame. The bucket is pivotally attached to one end of a control rod 40, the other end of the control rod 40 being pivotally connected to a first bracket 42. The bucket 32 is tilted or racked by extending and retracting a bucket tilt cylinder 44 that is pivotally connected between the first bracket 42 and a second bracket 46.

Figure 2:
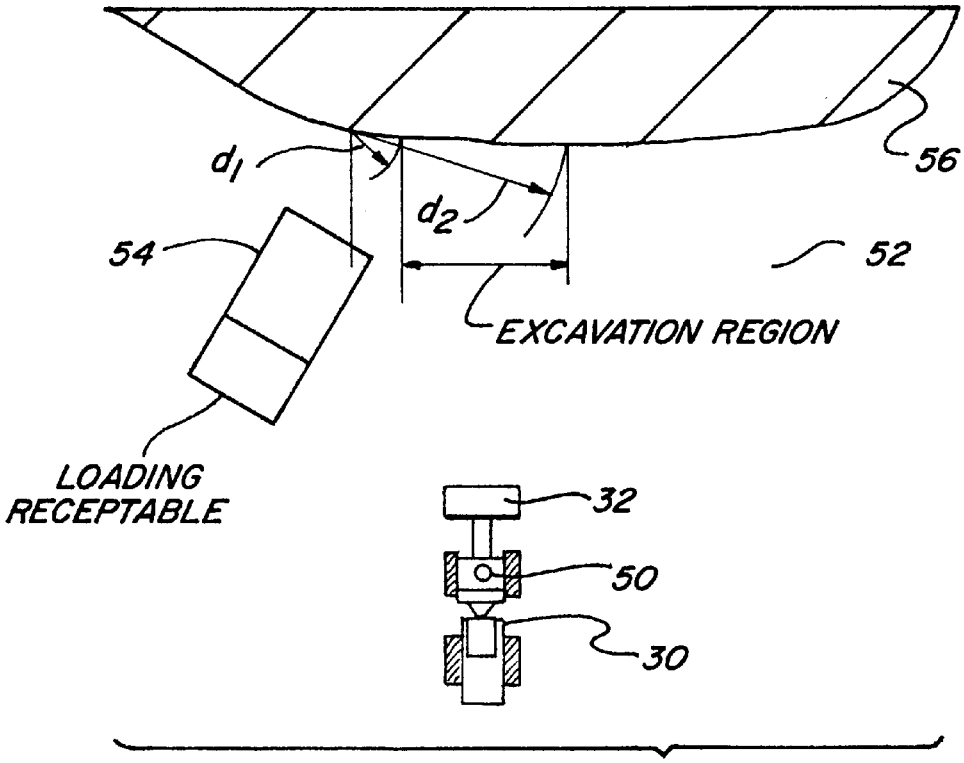
FIG. 2 is a top plan view of a front-end loader at a work site showing the parameters evaluated in a coarse planner for defining the region of the work site from which material should be removed.

As shown in FIG. 2, the front-end loading machine 30 may be equipped with one or more sensor systems 50 that are positioned to provide information regarding the work site 52 throughout the progress of the work cycle. The sensor system 50 provides information on different regions of the excavation environment to a control system (not shown) for planning movement of the front-end loading machine 30 and operation of the bucket 32. The control system may process information for planning and executing the tasks associated with the work cycle of the machine 30, such as loading the bucket with material and unloading the material in a loading receptacle 54. When more than one sensor system 50 is used, the control system may operate the sensors 50 independently to provide information about separate regions of the work site 52. This allows different portions of the work cycle to be planned and executed concurrently. The sensor systems 50 may also be controlled to provide information regarding the same area to allow a task to be performed with higher resolution data. Whether operating independently or cooperatively, the sensor systems 50 are positioned on the front-end loading machine 30 or at a location near the work site 52 that allows the sensors to scan the desired portions of the environment. The data acquired by the sensor systems 50 is sent to a data server (not shown) and processed to create an elevation map of the surrounding terrain. This terrain map can be used by the present excavation planner as it surveys the surrounding area for the optimum excavation site.

Figure 3:
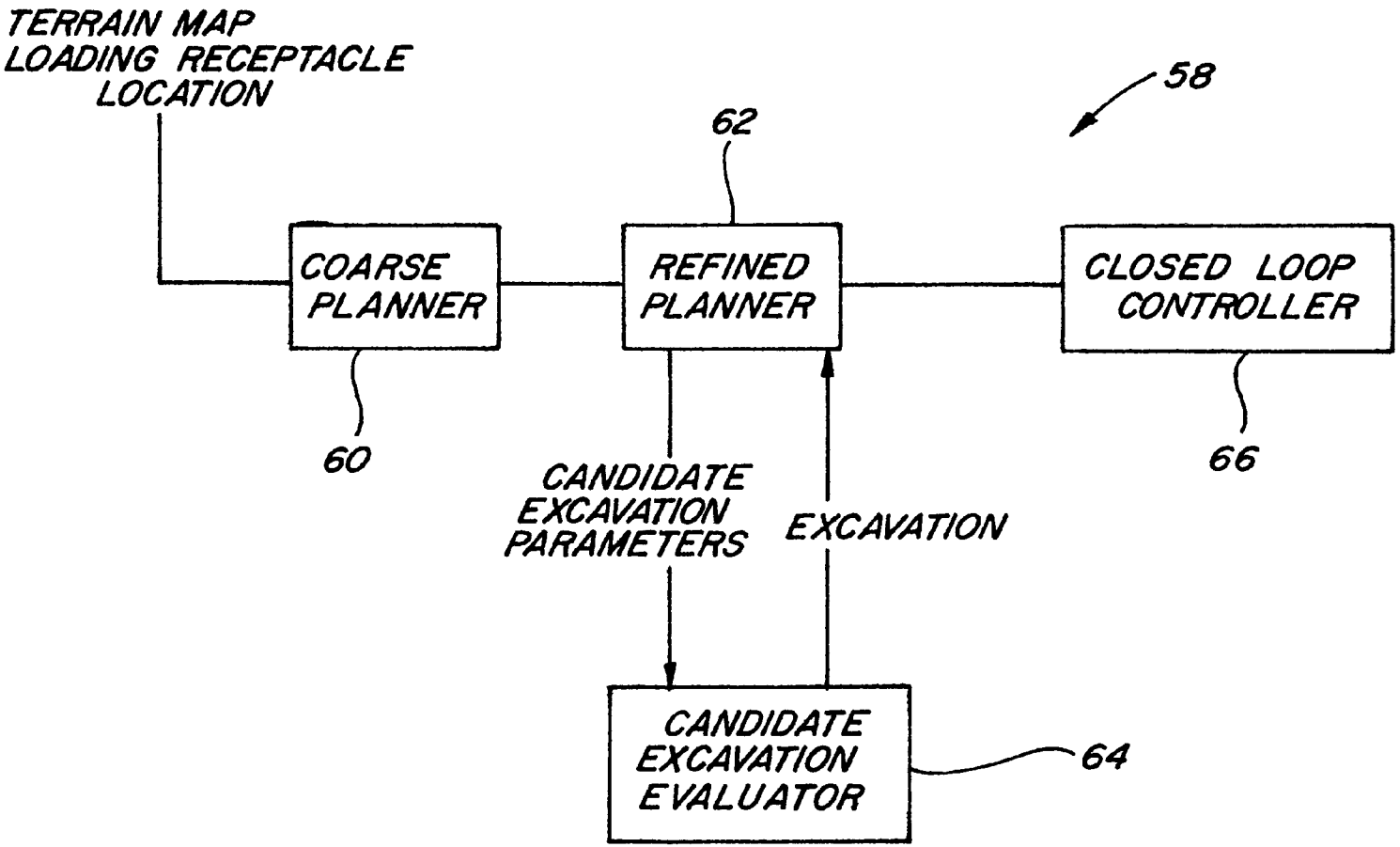
FIG. 3 is a functional block diagram of the components associated with the present invention.

FIG. 3 shows a block diagram of the components of an embodiment of an excavation planner 58 according to the present invention. The components of the present excavation planner 58 include a coarse planner 60, a refined planner 62, a candidate excavation evaluator 64, and a closed loop controller 66. The coarse planner 60 receives information regarding the work site 52 from the terrain map, which may be stored in a data server (not shown), including information regarding the loading receptacle 54 or other location in which to unload the excavated material. The coarse planner 60 determines the boundaries of the pile of material 56 with an edge detection algorithm. Once the edges are detected, the coarse planner 60 searches for the edge point that is nearest to the loading receptacle 54. The coarse plan is then defined as the set of edge points that lie within a range of distances from this nearest point. The range of distances may be values defined in widths of the bucket 32, such as from one-half to three bucket widths, or any other suitable measure.

In order to simplify the calculations performed by coarse planner 60, it may be assumed that the loading receptacle 54 is already positioned in place before the loading begins. It may alternatively be assumed that the loading receptacle 54 is positioned relative to the excavation site, and the excavation planner 58 could command the front-end loading machine 30 to remove material from any location at the site. In this situation, multiple regions may be defined, and the order of the region selection could be based on objectives for material removal, such as achieving a desired shape.

Figure 4:
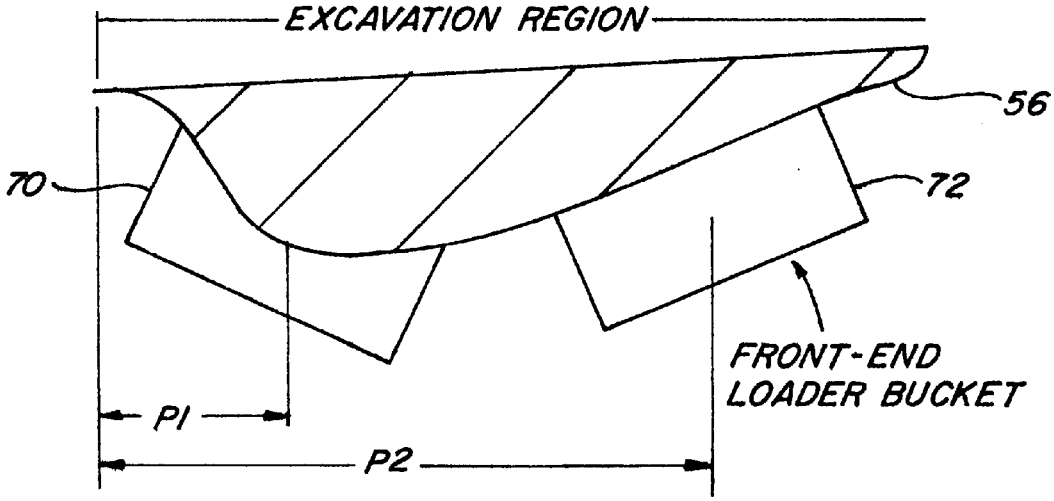
FIG. 4 is a top plan view of a front-end loader at the work site showing the parameters evaluated in a refined planner for defining a location of the bucket for removing a pile of material.

The refined planner 62 involves using an approach, or heuristics, typically followed by expert operators for efficient removal of material. The goal of the refined planner 62 is to determine the starting position and orientation (pose) of the front-end loading machine 30. The closed loop controller 66 controls the machine through the actual excavating process thereafter. FIG. 4 shows an example of two candidate starting locations $p_1$, $p_2$ and the corresponding orientation of the bucket outlines 70, 72 with respect to the face of the pile of material 56. Several expert heuristics may be used in the refined planner 62 to reduce the number of candidate starting poses. One such heuristic is to start the excavation with the bucket 32 flat on the ground to help prevent tire damage from loose rocks. This eliminates the need to determine a starting angle and elevation for the bucket 32. Another such heuristic is that the front-end loading machine 30 should begin excavating in a direction approximately perpendicular to the face of the soil or pile of material 56. This helps prevent uneven loading of the bucket 32, which can cause tire damage if the wheels of the front-end loading machine 30 slip due to the uneven loading. This heuristic may be met by choosing a starting location where both front corners of the bucket 32 are proximate the pile of material 56 simultaneously at the beginning of the excavation, as exemplified by the bucket outlines 70, 72 in FIG. 4. The perpendicularity heuristic aids in determining the direction at which the front-end loading machine 30 should approach the pile of material 56.

Figure 5:
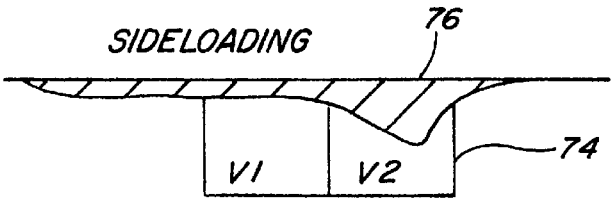
FIG. 5 shows an example of performance criteria for selecting the excavation region.

The optimum starting position is found by evaluating the results achieved by the refined planner 62 for several candidate starting locations, $p_i$. In the preferred embodiment, three performance criteria are quantified to provide means for selecting the starting location that achieves optimum results. The first performance criteria is the side loading criteria, which is shown in FIG. 5. The outline of a front-end loader bucket 74 is shown at a candidate starting location, with both corners of the bucket 74 touching the edge of the pile of material 76. As shown in FIG. 5, the contour of the pile of material 76 is uneven inside the perimeter of the bucket 74, with a lesser volume of material in one subsection V1 of the bucket 74 than in another subsection V2. The formula for quantifying the extent of side loading (SL) for a candidate starting location is:

$$SL = 1 - \frac{|V1 - V2|}{V1 + V2}$$

This formula results in a value for SL that increases as the volume of material in the bucket becomes more evenly distributed. Therefore, larger values of SL, approaching the number one, are desirable. The values for V1 and V2 may be determined by processing range data provided by the sensor system 50.

Figure 6:
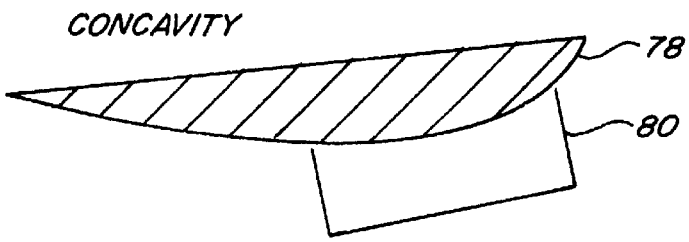
FIG. 6 shows another example of performance criteria for selecting the excavation region.

The second performance criteria is the concavity criteria, which is shown in FIG. 6. Expert front-end loader operators prefer to excavate at locations where the material protrudes from the pile 78, and avoid areas that are recessed. This strategy results in more efficient excavation because the force applied by the front-end loading machine 30 is directed to the cutting edge of the bucket 80 instead of the side edges of the bucket 80. If the perimeter of the pile of material 78 is highly curved or concave, there will be more material in the bucket 80 at the starting location than if the perimeter of the pile was flat or recessed. As shown in FIG. 6, the concavity value C is simply a ratio of the volume of material in the bucket 80 to the maximum bucket capacity. The value for C approaches the number one as the amount of material captured in the bucket 80 approaches the maximum amount of material the bucket 80 can hold.

Figure 7:
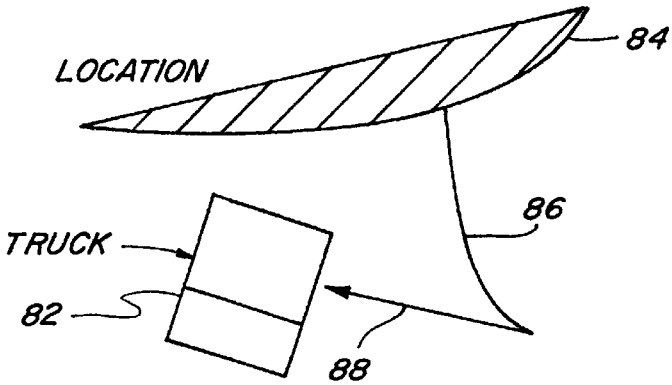
FIG. 7 shows another example of performance criteria for selecting the excavation region.

A third performance criteria, as shown in FIG. 7, is used to choose a starting location which minimizes the distance the front-end loader 30 has to travel to load the excavated material in the loading receptacle 82. In a typical situation, the front-end loader 30 will back up from a pile of material 84 along a curved or arcuate path 86 away from the loading receptacle 82 after the bucket 32 is loaded. The front-end loader 30 is then moved along a straight path 88 toward the loading receptacle 82. The distance along the curved and straight paths 86, 88 is calculated and a function, such as the function shown in FIG. 7, may be calculated to quantify the quality of the trajectory. The distance that the front-end loader 30 must move between the pile of material 84 and the loading receptacle 82 affects the amount of time required to complete a work cycle. The function shown in FIG. 7 requires information regarding the maximum acceptable distance that the front-end loader 30 should be moved for an acceptable level of productivity. The value of L, to signify location, is determined according to the following equation:

$$L = 1 - \frac{\text{distance_to_travel}}{\text{maximum_acceptable_distance}}$$

In this equation, the maximum value of L is one (1) if the distance_to_travel is zero. The minimum value of L is limited to zero if the distance_to_travel is greater than the maximum acceptable distance.

An overall quality rating is determined by adding the quantitative values for side loading, concavity, and location as follows:

$$\text{Quality}=SL+C+L$$

With the functions for SL, C and L, shown in FIGS. 5, 6, and 7, greater values for Quality indicate more desirable candidate excavations, with the number three (3) denoting the highest quality. Other functions and performance criteria may be evaluated to determine the quality of a candidate excavation including a set of functions where lower numbers indicate higher quality candidates. The functions shown in FIGS. 5, 6, and 7 are provided as examples of functions that may be used in the preferred embodiment. A particular embodiment may include a Quality formula that weighs the performance criteria differently, to emphasize factors that may be more critical in some applications. Further, an embodiment may use only one or two of the performance criteria to evaluate the quality of the candidate starting locations.

Other performance criteria may be used in the present invention to help limit the number of candidate excavations to evaluate. In a preferred embodiment, one additional performance criteria that may be imposed is, as shown in FIG. 7, the front-end loader 30 must be able to travel between the excavation area 84 and the loading receptacle 82 in a path or trajectory having two segments 86, 88. Limiting movement to two segments results in higher productivity than a path having more segments. Another performance criteria that may be imposed is that the front-end loader 30 cannot collide with the loading receptacle 82, the pile of material 84, or other objects or material along the path.

Figure 8:
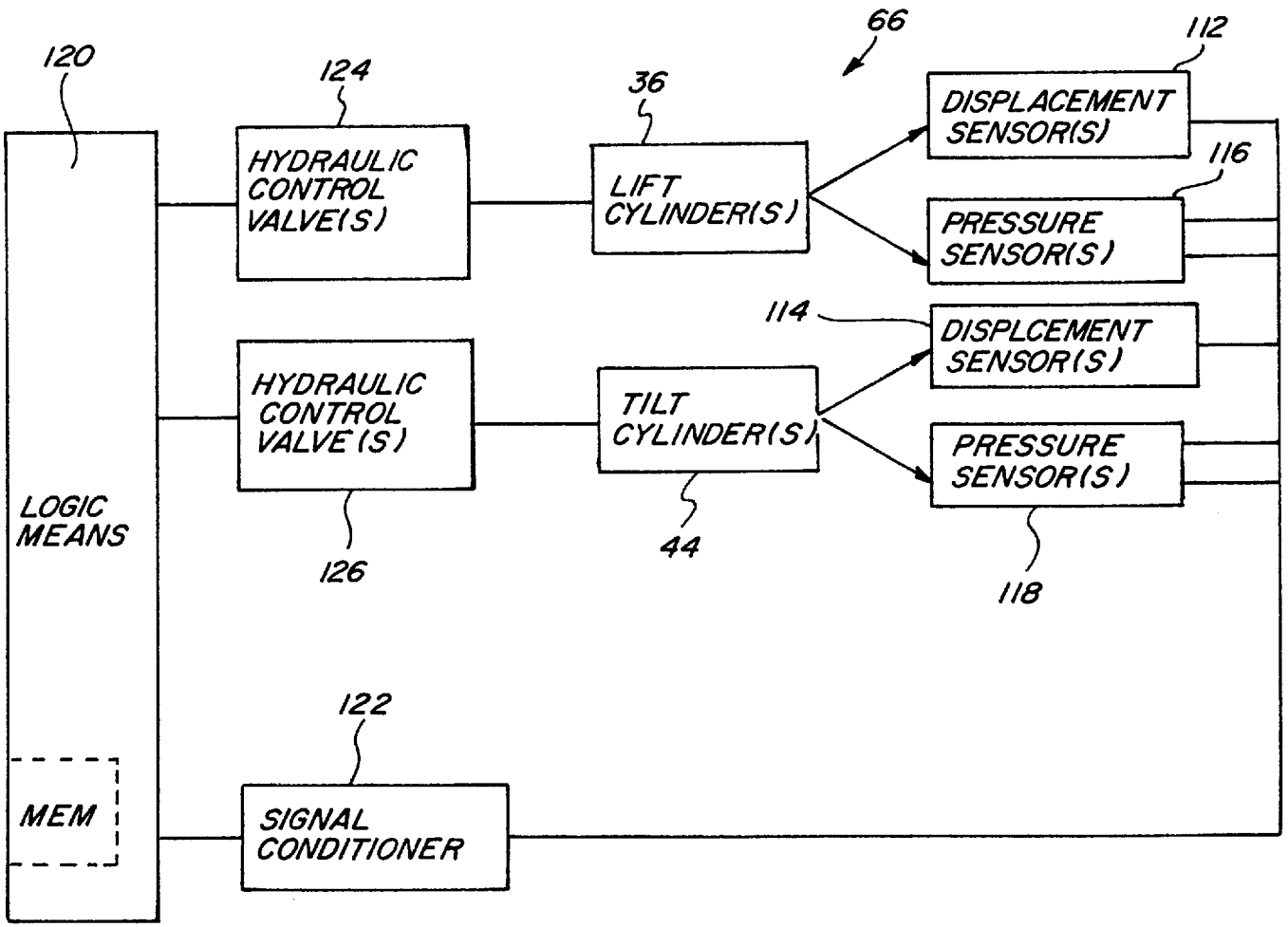
FIG. 8 shows a block diagram of a control system for a front-end loader.

The closed loop controller 66 for the work implement generates commands for controlling actuation of hydraulic cylinders which are operably connected through linkages to the bucket. FIG. 8 shows a block diagram of an embodiment of the closed loop controller 66 that may be incorporated with the present invention. The closed loop controller 66 includes displacement sensors 112, 114 that produce respective position signals in response to the respective positions of the lift and tilt cylinders 36, 44. Pressure sensors 116, 118 produce respective pressure signals in response to the associated hydraulic pressures associated with the lift and tilt cylinders 36, 44. A microprocessor 120 receives the position and pressure signals through a signal conditioner 122, and produces command signals that controllably actuate predetermined control valves 124, 126 which are operably connected to the lift and tilt cylinders 36, 44 to perform the work cycle. The microprocessor 120 uses the pressure signals and cylinder positions to guide the bucket 32 during the excavation and to determine when digging is complete.

Industrial Applicability

The present invention for planning the excavation location for leveling a mound of soil or other material involves a multi-level planning and execution scheme. Given a description of the terrain in the form of a terrain map, performance criteria for candidate excavations based on the distribution of the loads in the bucket 32, the volume excavated, and the distance traveled during the work cycle, the present invention determines an optimal location from which to start the excavation. Treatment of the problem at multiple levels meets different objectives. The coarse planner 60 helps promote even removal of material while optimizing performance over a large number of excavation cycles. The refined planner 62 quantifies the quality of proposed starting locations and chooses actions that meet geometric constraints and that achieve desired results in the most optimal fashion.

Figure 9:
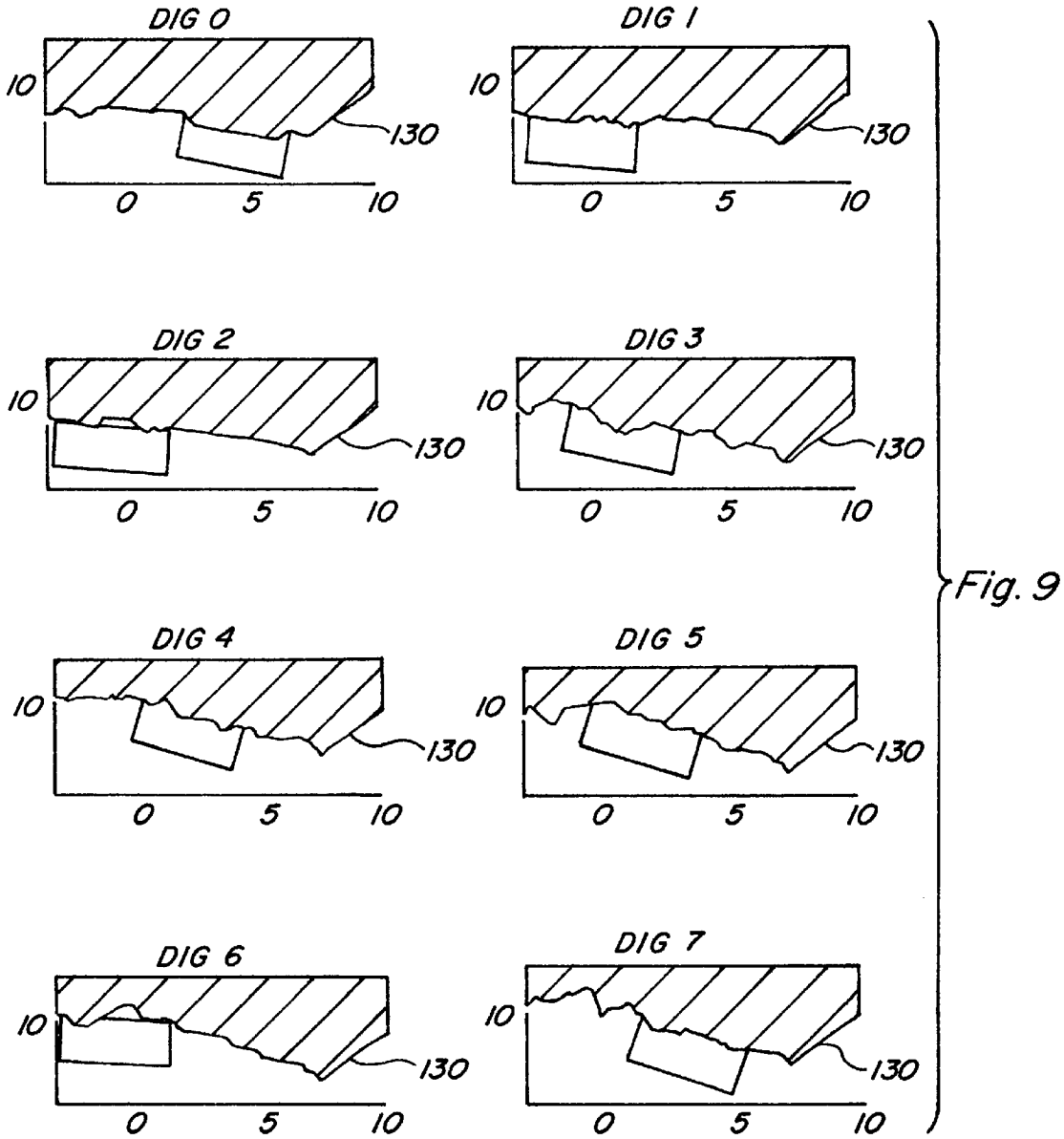
FIG. 9 shows a top plan view of the results of a series of excavations using the present invention.

FIG. 9 shows the excavation results achieved with a front-end loader wherein the present invention was used to plan the excavation and determine starting locations for each work cycle. Each graph shows the profile of the terrain 130 after successive excavations, along with the orientation of the bucket 132 with respect to the terrain 130. The present excavation planner results in the longitudinal axis of the bucket 132 being perpendicular to the profile of the terrain 130, and the bucket 132 being centered on protrusions from the terrain 130.

Other aspects, objects and advantages of the present invention can be obtained from a study of the drawings, the disclosure and the appended claims.

What is claimed is:

1. A method for planning earthmoving operations using a terrain map of an excavation area, and a front-end loading machine having a work implement including a bucket, the method comprising the steps of:

(a) determining a plurality of candidate regions for starting an excavation;

(b) determining a quality rating for each candidate region by evaluating at least one performance criterion associated with selecting the optimum position for starting the excavation; and (c) selecting one of said plurality candidate regions as a starting location as a function of the quality rating.

2. The method, as set forth in claim 1, wherein the step (a) further comprises determining edge points of each candidate region and determining the boundary of each candidate region by examining the distance of the edge points to a loading receptacle in which the excavated material will be loaded.

3. The method, as set forth in claim 1, wherein the step (a) further comprises determining an orientation of the bucket for each candidate region wherein the front corners of the bucket are proximate the pile of material.

4. The method, as set forth in claim 1, wherein the at least one performance criterion includes the uniformity of distribution of the material in the bucket.

5. The method, as set forth in claim 1, wherein the at least one performance criterion includes the concavity of material at the candidate location.

6. The method, as set forth in claim 1, further comprising step (d) of determining a proposed path of movement between the starting location and the loading receptacle.

7. The method, as set forth in claim 6, wherein the step (d) further comprises determining whether the distance along the proposed path of movement is within a maximum allowable distance.

8. The method, as set forth in claim 6, wherein the step (d) further comprises determining whether the front-end loading machine is capable of being maneuvered along the proposed path of movement.

9. An apparatus for planning earthmoving operations using a work implement of a front-end loading machine, the work implement includes a bucket, the planning apparatus comprises:

a terrain map of an excavation site represented in numerical form; and a data processor operable to determine a plurality of candidate regions of the bucket for starting an excavation based upon the terrain map, the data processor further operable to determine a quality rating for each candidate region by evaluating at least one performance criterion associated with selecting the optimum position for starting the excavation, and to select one of said plurality of candidate regions as a starting location as a function of the quality rating.

10. The apparatus, as set forth in claim 9, wherein the data processor is further operable to determine a plurality of edge points of the excavation site and an edge point of the plurality of edge points that is closest to a loading receptacle in which the excavated material will be loaded.

11. The apparatus, as set forth in claim 9, wherein the data processor is further operable to determine an orientation of the longitudinal axis of the bucket for each candidate region wherein the front corners of the bucket are proximate the pile of material.

12. The apparatus, as set forth in claim 9, wherein the at least one performance criterion includes the uniformity of distribution of the material in the bucket.

13. The apparatus, as set forth in claim 9, wherein the at least one performance criterion includes the concavity of material at the candidate location.

14. The apparatus, as set forth in claim 9, wherein the data processor is further operable to determine a proposed path of movement between each candidate region and a loading receptacle.

15. The apparatus, as set forth in claim 14, wherein the data processor is further operable to determine whether the distance along the proposed path of movement is within a maximum allowable distance.

16. The apparatus, as set forth in claim 14, wherein the data processor is further operable to determine whether the front-end loading machine is capable of being maneuvered along the proposed path of movement.

* * * * *